US011795417B2

(12) United States Patent
Tibbs et al.

(10) Patent No.: US 11,795,417 B2
(45) Date of Patent: Oct. 24, 2023

(54) DISSOLVABLE SHEET CONTAINING A CLEANING ACTIVE AND METHOD OF MAKING SAME

(71) Applicants: Dizolve Group Corporation, Moncton (CA); BISSELL Inc., Grand Rapids, MI (US)

(72) Inventors: Kevin A. Tibbs, St. Louis, MO (US); Ala'a Al-Faraj, Riverview (CA); Daniel Alberto Carbo Dabove, Moncton (CA)

(73) Assignees: Dizolve Group Corporation, Moncton (CA); Bissell Inc., Grand Rapids, MI (US)

( * ) Notice: Subject to any disclaimer, the term of this patent is extended or adjusted under 35 U.S.C. 154(b) by 149 days.

(21) Appl. No.: 17/184,028

(22) Filed: Feb. 24, 2021

(65) Prior Publication Data

US 2021/0261885 A1 Aug. 26, 2021

Related U.S. Application Data

(60) Provisional application No. 62/980,644, filed on Feb. 24, 2020.

(51) Int. Cl.
*C11D 17/06* (2006.01)
*C11D 1/04* (2006.01)
(Continued)

(52) U.S. Cl.
CPC ..... *C11D 3/3454* (2013.01); *C11D 1/83* (2013.01); *C11D 1/94* (2013.01); *C11D 3/2044* (2013.01); *C11D 3/2079* (2013.01); *C11D 3/3753* (2013.01); *C11D 3/386* (2013.01); *C11D 3/50* (2013.01); *C11D 11/0017* (2013.01); *C11D 17/044* (2013.01); *C11D 1/04* (2013.01); *C11D 1/143* (2013.01); *C11D 1/662* (2013.01); *C11D 1/75* (2013.01); *C11D 1/90* (2013.01)

(58) Field of Classification Search
None
See application file for complete search history.

(56) References Cited

U.S. PATENT DOCUMENTS 1,112,963 A 10/1914 Alexander
2,665,528 A 1/1954 Stemfield et al.
(Continued)

FOREIGN PATENT DOCUMENTS

CA 2695068 9/2010
CA 3040581 10/2020
(Continued)

*Primary Examiner* — Lorna M Douyon
(74) *Attorney, Agent, or Firm* — Boyle Fredrickson, S.C.

(57) ABSTRACT

A dissolvable sheet having a water-soluble substrate, and one or more cleaning actives disposed uniformly throughout the water-soluble substrate. The water-soluble substrate is formed from a first substrate builder comprising polyvinyl alcohol, a second substrate builder, such as starch, and sodium laurylglucosides hydroxypropylsulfonate, and is sized and shaped to form a sheet, and hold a premeasured amount of the cleaning active. The substrate dissolves when contacted with a sufficient amount of water, thereby releasing the cleaning active into the water, which also dissolves in the water. A method of making the dissolvable sheet is also disclosed.

12 Claims, 1 Drawing Sheet

(51) Int. Cl.

| | |
|---|---|
| ***C11D 1/14*** | (2006.01) |
| ***C11D 1/83*** | (2006.01) |
| ***C11D 1/75*** | (2006.01) |
| ***C11D 1/90*** | (2006.01) |
| ***C11D 1/94*** | (2006.01) |
| ***C11D 3/20*** | (2006.01) |
| ***C11D 3/22*** | (2006.01) |
| ***C11D 3/33*** | (2006.01) |
| ***C11D 3/37*** | (2006.01) |
| ***C11D 3/386*** | (2006.01) |
| ***C11D 3/34*** | (2006.01) |
| ***C11D 3/50*** | (2006.01) |
| ***C11D 11/00*** | (2006.01) |
| ***C11D 17/04*** | (2006.01) |
| *C11D 1/66* | (2006.01) |

(56) References Cited

U.S. PATENT DOCUMENTS

| | | | |
|---|---|---|---|
| 3,062,030 | A | 11/1962 | Groves |
| 3,694,364 | A | 9/1972 | Edwards |
| 3,904,543 | A | 9/1975 | Knighten |
| 3,950,277 | A | 4/1976 | Stewart et al. |
| 4,188,304 | A | 2/1980 | Clarke et al. |
| 4,356,099 | A | 10/1982 | Davies et al. |
| 4,374,035 | A | 2/1983 | BOSSu |
| 4,806,261 | A | 2/1989 | Ciallella et al. |
| 4,853,142 | A | 8/1989 | Win et al. |
| 4,938,888 | A | 7/1990 | Kiefer et al. |
| 5,574,179 | A | 11/1996 | Wahl et al. |
| 5,780,418 | A | 7/1998 | Niinaka et al. |
| 5,863,887 | A | 1/1999 | Gillette |
| 6,699,826 | B1 | 3/2004 | Saijo et al. |
| 6,756,351 | B2 | 6/2004 | Weuthen |
| 6,818,606 | B1 | 11/2004 | Hanada et al. |
| 6,831,051 | B2 | 12/2004 | Sommerville-Roberts et al. |
| 6,864,196 | B2 | 3/2005 | Graham et al. |
| 6,949,498 | B2 | 9/2005 | Murphy et al. |
| 6,995,126 | B2 | 2/2006 | Perkis et al. |
| 7,094,744 | B1 | 8/2006 | Kobayashi et al. |
| 7,544,409 | B2 | 6/2009 | Copland et al. |
| 8,669,219 | B2 | 3/2014 | Wiedemann et al. |
| 9,464,264 | B2 | 10/2016 | Jalbert et al. |
| 2002/0077265 | A1 | 6/2002 | Buzzacaraini et al. |
| 2002/0169092 | A1 | 11/2002 | Alexandre Catlin et al. |
| 2004/0046272 | A1 | 3/2004 | Arai et al. |
| 2005/0037942 | A1 | 2/2005 | Otterson et al. |
| 2008/0014393 | A1 | 1/2008 | Denome et al. |
| 2008/0064618 | A1 | 3/2008 | Bastigkeit et al. |
| 2008/0242579 | A1 | 10/2008 | Briggs et al. |
| 2009/0291282 | A1 | 11/2009 | Kitamura et al. |
| 2010/0035789 | A1 | 2/2010 | Caswell et al. |
| 2010/0190677 | A1 | 7/2010 | Esposito et al. |
| 2011/0028374 | A1 | 2/2011 | Fossum et al. |
| 2011/0136719 | A1 | 6/2011 | Jalbert et al. |
| 2012/0046215 | A1* | 2/2012 | Hodge ..... C11D 1/008 510/470 |
| 2012/0207699 | A1 | 8/2012 | McHatton et al. |
| 2014/0024574 | A1 | 1/2014 | Angell et al. |
| 2015/0218497 | A1* | 8/2015 | Jalbert ..... B29C 41/12 118/68 |
| 2019/0105242 | A1* | 4/2019 | Song ..... A61K 8/44 |
| 2019/0216713 | A1* | 7/2019 | Scheunemann ..... A61K 8/44 |
| 2020/0405587 | A1* | 12/2020 | Song ..... A61Q 5/02 |

FOREIGN PATENT DOCUMENTS

| | | |
|---|---|---|
| CN | 101063066 | 10/2007 |
| CN | 102492573 | 6/2012 |
| EP | 2226379 | 9/2010 |
| KR | 20130124261 | 11/2013 |
| WO | 2004087857 | 10/2004 |
| WO | 2006134657 | 12/2006 |
| WO | 2007034471 | 3/2007 |
| WO | WO 2007/076466 A2 * | 7/2007 |
| WO | WO 2011/055327 A2 * | 5/2011 |

* cited by examiner

DISSOLVABLE SHEET CONTAINING A CLEANING ACTIVE AND METHOD OF MAKING SAME

CROSS-REFERENCE TO RELATED APPLICATION

This application claims benefit from U.S. Application Ser. No. 62/980,644, filed Feb. 24, 2020.

FIELD OF THE INVENTION

The present invention relates to the fields of laundry detergent preparations, dish detergent preparations, and automatic dishwasher detergent preparations. More particularly, the present invention relates to a dissolvable sheet containing a premeasured unit dose of a cleaning active sufficient for a single cleaning operation, and method of making such a sheet.

BACKGROUND OF THE INVENTION

Cleaning agents, including detergents, are typically provided in liquid or powder forms. However, users find these forms inconvenient because their use requires an additional step of measuring out a correct dose of the detergent. Apart from the inconvenience of measuring out a correct dose is the material cost associated with the need to provide and store a utensil for measuring out the correct dose, and then load the correct dose, for example, into a dishwasher, a washing machine, or other like washing apparatus. Associated with this requirement for measuring a dose is the risk of getting the dose wrong, and either under-dosing (resulting in poor cleaning action), or over-dosing (resulting in wasted detergent, or damage to the item being cleaned). Other problems associated with liquid and powder forms of cleaning agents are that they are messy. They are also not easily transportable in small quantities, which may be desirable when travelling, for example.

Another issue with liquid and powder detergents is the volume and weight associated with their liquid and powder forms. Both forms are heavy and require significant packaging to transport and sell.

In light of the above-noted problems associated with liquid and powder forms of cleaning agents, many users prefer cleaning agents, such as for example, laundry detergents, that are provided in a form that is simpler to use and less messy than the liquid and powder forms.

Attempts have been disclosed in the prior art to overcome some of the above described problems associated with liquid and powder cleaning agents. Some of the attempts included providing a unit dose laundry detergent product, which removed the need to measure out a correct dose of laundry detergent, thereby simplifying for the user the process of loading a washing machine with the correct dose of the laundry detergent.

For example, U.S. Pat. No. 4,356,099 to Davies disclosed fabric treatment products for use in washing machines consisting of a bag formed of water-insoluble, water-impermeable synthetic plastics sheet material containing a fabric treatment composition comprising a liquid fabric treatment composition, such as an aqueous or non-aqueous liquid detergent composition. The bag has a weak seal that will be opened by the mechanical action of a washing machine, to release its liquid detergent contents. However, a problem with the fabric treatment products disclosed by Davies is that they are prone to a failure of the weak seal not opening properly in modern day high efficiency (HE) washing machines. This is because opening of the weak seal in a Davies fabric treatment product relies on the mechanical action of the washing machine, and the more gentle mechanical action of HE washing machines may not be enough to open the bag. Additionally, because the bag is made of a water-insoluble material, it remains in the washing machine during the entire wash cycle, and can affect the cleaning performance if it clings to certain areas of the clothing being washed. Furthermore, the format of the fabric treatment products taught by Davies does not allow for partial doses that may be better suited for laundry loads which are smaller than full loads.

As another example, U.S. Pat. No. 4,188,304 to Clarke discloses a detergent product which comprises a particulate detergent composition contained within a closed water-insoluble bag which has a water-sensitive seal, whereby the contents of the bag are discharged on contact of the bag with water. Clarke's detergent product shares many of the same problems noted above in connection to Davies. However, an additional problem with the Clarke detergent product is that it is difficult to ensure that all of the particulate detergent composition is emptied out of the bag and fully dissolved in the water, especially if the detergent product is used in the detergent dispensing trays on modern HE washing machines.

As yet another example, laundry detergent pods have become popular in recent years, in which a single premeasured unit dose of detergent is encapsulated in a water-soluble pouch, typically ranging from 20 to 40 grams in weight. However, a problem associated with such laundry detergent pods is that they do not dissolve readily because the water-soluble pouch covering the detergent powder must dissolve before the water can access the detergent. Furthermore, the detergent is provided as a large mass of partially-compressed powder, which presents a smaller overall surface area for the water to act on. For these reasons, such pods typically do not dissolve fully when used in the detergent dispensing trays on modern HE washing machines.

As yet another example, laundry detergent tablets exhibit similar problems as those described above with respect to laundry detergent pods, due to the large concentrated mass of highly-compressed detergent powder.

In general, detergent dispensing trays on modern HE washing machines provide too short a time for dissolving the above-noted laundry detergent pods and laundry detergent tablets, and so they fail to yield optimal results when used in this way. For this reason, laundry detergent pods are better suited for being placed directly in the washing machine drum to be dissolved during the wash cycle.

Neither the laundry detergent pod, nor the laundry detergent tablet formats allow for partial doses that may be better suited for laundry loads which are smaller than full loads.

As yet another example, U.S. Pat. No. 4,853,142 to Win disclosed a high melting temperature meltblown web, such as a polyester meltblown web, which contains a sufficient amount of condensed liquid detergent to wash a load of laundry and does not exhibit an objectionable sticky feel. Similarly, U.S. Pat. No. 4,938,888 to Kiefer disclosed a cleaning article formed from a detergent composition impregnated into a flexible substrate. The detergent composition includes an alkyl polyglycoside and a detergency builder. The substrates employed are water-insoluble and are solid or substantially solid materials, such as foam, foil, sponge, paper, woven or non-woven cloth.

A problem shared by both Win and Kiefer is that they are made with non-dissolvable substrates, which remain in the washing machine drum after completion of the wash cycle. The non-dissolvable substrates also tend to cling to clothing being washed, making it more difficult for the embedded detergent to dissolve completely. Additionally, non-dissolvable substrates are not compatible with detergent dispensing trays on modern HE washing machines, and both of Win's webs and Kiefer's cleaning articles, impregnated with detergent composition sufficient for a full load, would be too large to be used efficiently and reliably in the detergent dispensing trays on modern HE washing machines. Additionally, neither Win's web nor Kiefer's cleaning article allow for partial doses that may be better suited for laundry loads which are smaller than full loads.

As yet another example, U.S. Pat. No. 9,464,264 to Jalbert disclosed a method and apparatus for making dissolvable laundry detergent sheets, containing laundry detergent, for use in washing machines. The Jalbert laundry detergent sheets dissolve completely in the drum of the washing machine during the wash cycle, thereby releasing their laundry detergent contents to the wash water.

However, the Jalbert dissolvable laundry detergent sheets are made by a method that uses sulfate and ethoxylate chemistries, whereas consumers are increasingly desiring products to be free of sulfates and ethoxylates.

Additionally, Jalbert's method of making dissolvable laundry detergent sheets requires increasing the concentration of the cleaning active in the sheet, or increasing the size of the sheet to increase the amount of cleaning active contained in the sheet, because the amount of cleaning active contained in a sheet is limited by the size of the sheet.

As yet another example, CA Patent App. No. 3,040,581 to Al-Faraj disclosed an active composition delivery system having a water-soluble substrate, and an active composition disposed uniformly throughout the water-soluble substrate. The water-soluble substrate is sized and shaped to form a sheet, and hold a premeasured amount of an active composition.

Although Al-Faraj's active composition delivery system teaches sulfate and ethoxylate free chemistries, it would be desirable to increase the amount of cleaning active that can be disposed throughout the water-soluble substrate.

Other prior art attempts include those disclosed in: U.S. Pat. Nos. 1,112,963; 2,665,528; 3,062,030; 3,694,364; 3,904,543; 3,950,277; 4,374,035; 4,806,261; 5,574,179; 5,780,418; 5,863,887; 6,699,826; 6,756,351; 6,831,051; 6,818,606; 6,864,196; 6,949,498; 6,995,126; 7,094,744; 7,544,409, and 8,669,219; and U.S. Patent Application Publication Nos. 2002/0077265; 2004/0046272; 2005/0037942; 2008/0014393; 2008/00064618; 2008/0242579; 2009/0291282; 2010/0035789; 2010/0190677; 2011/0028374; 2011/0136719; 2012/0207699; 2014/0024574; and 2002/0169092.

Other prior art attempts include those disclosed in: CA 2,695,068; CN 101063066; CN 102492573; EP 2226379; KR 20130124261; WO 2004087857; WO 2006134657; and WO 2007034471.

Accordingly, there remains a need for improvements in dissolvable sheets containing a cleaning active and methods for making such dissolvable sheets.

SUMMARY OF THE INVENTION

What is desired is a dissolvable sheet containing a cleaning active and a method of making such a sheet, that overcomes at least some of the problems in the prior art.

For example, what may be desired is a dissolvable sheet containing one or more cleaning actives that is free of sulfates, and ethoxylates. Preferably, the one or more cleaning actives may contain one or a combination of sulfate- and ethoxylate-free surfactants.

As another example, what may be desired is a dissolvable sheet containing more cleaning active for a given size of the sheet as compared to a prior art dissolvable sheet.

According to a preferred embodiment of the present invention, the ingredients used to make the dissolvable sheets are mixed in three separate batches. A First Solution and a Second Solution may be made separately in two large batches because they are preferably made to be shelf-stable, in that they are storable for a relatively long period of time (i.e. two months or longer) after the ingredients are thoroughly mixed together. A Final Solution, which includes portions of the First Solution and the Second Solution, may be made in a smaller batch for immediate use. The Final Solution is typically non-shelf stable, in that it is usable only for a relatively short period of time (i.e. four to eight hours or less) after the ingredients are thoroughly mixed together, because it tends to deteriorate.

Preferably, the Final Solution may be applied to a heated surface to dry, thereby forming the dissolvable sheet. Provided that the drying step is undertaken in a timely manner the deterioration problem identified above may be avoided.

Preferably, the dissolvable sheet may have a water-soluble substrate, and a cleaning active disposed uniformly throughout the water-soluble substrate. The water-soluble substrate may be sized and shaped in the form of a sheet, and hold a premeasured amount of the cleaning active. The water-soluble substrate dissolves when contacted with a sufficient amount of water, thereby releasing the cleaning active into the water. Preferably, the water-soluble substrate may include Polyvinyl alcohol (PVA), Glycerin, Sodium laurylglucosides hydroxypropyisulfonate, and Starch, and will be free of sulfates and ethoxylates.

Preferably, the cleaning active may also be water-soluble, in which case the dissolvable sheets will be completely dissolvable in water. Examples of preferred cleaning actives include Alpha olefin sulfonate (AOS), Potassium cocoate, Alkyl polyglucoside (C10-C16), Lauramine oxide, and Sodium laurylglucosides hydroxypropylsulfonate.

Sodium laurylglucosides hydroxypropylsulfonate (i.e. manufactured by Colonial Chemical, South Pittsburgh, TN, under the trade name Suga®Nate 160 Dry) is a 100% biobased sulfate-free surfactant in anhydrous form. Unexpectedly, the applicant has discovered that Sodium laurylglucosides hydroxypropylsulfonate may be used both as a water-soluble substrate builder as well as a cleaning active.

Preferably, the dissolvable sheets may also include enzymes, such as Medley® Brilliant 100L (i.e. manufactured by Novozymes A/S, Milwaukee, WI), to increase cleaning performance. However, enzymes are sensitive to high temperatures, and for this reason if enzymes are included in the Final Solution, the drying temperature will need to be monitored and maintained below a temperature at which the enzymes lose their structural integrity, or denature, such as for example below 60° C.

It will be appreciated that the present invention comprehends many uses and applications, depending on the formulations of the cleaning active, and the substrate containing the cleaning active, comprised by the dissolvable sheets. For example, embodiments of the present invention may include laundry detergent preparations, dish detergent preparations, and automatic dishwasher detergent preparations. All such embodiments are comprehended by the present invention.

Furthermore, the present invention is not limited to a particular manner of use or application, but comprehends many manners of uses and applications. For example, embodiments of the present invention may be configured to enable the user to prepare a volume of a cleaning or treating solution for current use or for later use. For example, the user may dissolve a dissolvable sheet in a kitchen sink filled with a volume of water and use the solution to wash dishes. As yet another example, the user may dissolve a dissolvable sheet in a disposable or reusable storage bottle filled with a volume of water and later dispense the solution, on an as needed basis, to use as a liquid dish detergent, a liquid laundry detergent, or the like. As yet another example, the user may deposit a dissolvable sheet in the tub of a washing machine tub with clothes at the start of the wash cycle. As yet another example, the user may place a dissolvable sheet in the detergent dispenser of a washing machine or an automatic dishwasher at the start of the wash cycle, as the case may be. All such embodiments are comprehended by the present invention.

Therefore, in accordance with one aspect of the present invention there is disclosed a method of making a dissolvable sheet containing one or more cleaning actives, which is free of sulfates and ethoxylates.

In accordance with another aspect of the present invention there is disclosed a method making a dissolvable sheet containing more cleaning actives for a given size of the sheet by increasing the ratio of cleaning actives to other components.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein.

Figure 1:
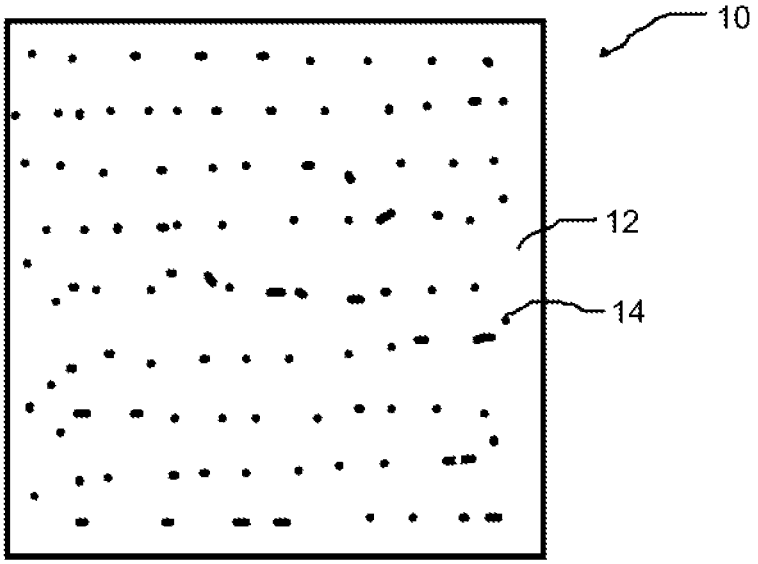
FIG. 1 is a top view of a dissolvable sheet containing a cleaning active, according to an embodiment of the present invention.
Figure 2:
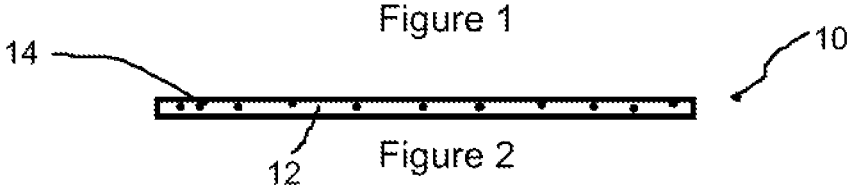
FIG. 2 is a side view of the dissolvable sheet of FIG. 1.

A dissolvable sheet 10 according to an embodiment of the present invention is shown in FIGS. 1 and 2. Preferably, the dissolvable sheet 10 has a water-soluble substrate 12, and a cleaning active 14 disposed uniformly throughout the water-soluble substrate 12. The water-soluble substrate 12 is preferably sized and shaped to form a sheet, and hold a premeasured amount of the cleaning active 14. The water-soluble substrate 12 is configured to dissolve when contacted with a sufficient amount of water, thereby releasing the cleaning active 14 into the water. According to the example shown in FIG. 1, the dissolvable sheet 10 may be sized and shaped to form a square sheet, which is, for example, about 102 mm long by about 102 mm wide, about 0.8 mm thick, and has a weight of about 4 grams. It will of course be appreciated that the dissolvable sheet may be formed with other dimensions and weights depending on the application, or the amount of cleaning active 14 required or desired to be stored in and delivered by the dissolvable sheet 10, when dissolved in water. Accordingly, it is contemplated that the dissolvable sheet 10 may be shaped as a rectangle, or any other polygon, including triangle, trapezoid, diamond, rhombus, parallelogram, and the like, as well as arcuate shapes, such as circles, ovals and the like, and combinations thereof. Furthermore, the lengths and widths may be larger or smaller than 102 mm, the thickness may be larger or smaller than 0.8 mm, and the weight may be larger or smaller than 4 grams. All such embodiments are comprehended by the present invention.

Figure 3:
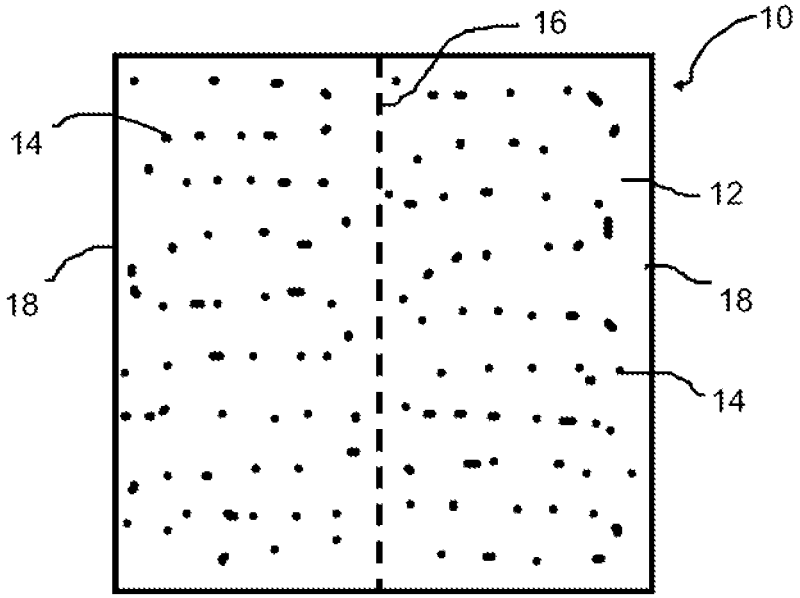
FIG. 3 is a top view of a dissolvable sheet that is easily severable into two smaller portions, according to another embodiment of the present invention.
Figure 4:
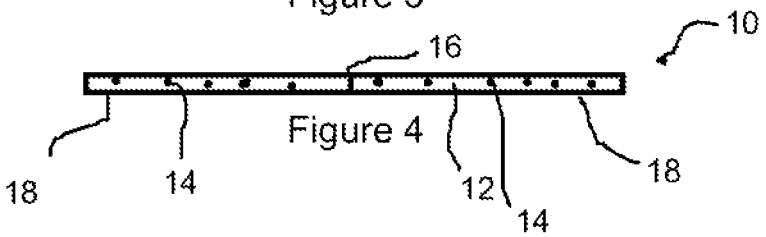
FIG. 4 is a side view of the dissolvable sheet of FIG. 3.

Referring now to FIGS. 3 and 4, the dissolvable sheet 10 may preferably be configured to allow the user to easily select a combination of premeasured unit doses for a particular application. Most preferably, the dissolvable sheet 10 may be provided with a frangible member, or line of weakness 16, to make it easier for the user to separate and remove one or more smaller portions 18 from the dissolvable sheet 10, so they may be used. Preferably, the frangible member/line of weakness 16 may be in the form of a line of perforations, cuts, partial cuts, or thinner material.

By way of example, the dissolvable sheet 10 shown in FIGS. 3 and 4 is in the shape of a square containing two smaller portions 18, that may be separated along the lines of weakness 16 by a user. It will be appreciated that the dissolvable sheet may contain more or fewer such portions 18. In this example, the portions 18 have the same dimensions. For example, the portions 18 may each be good for a partial application, such as for example delivering cleaning active to wash water in a washing machine suitable for a half load of laundry. Accordingly, a user would be able to use the full dissolvable sheet with a full load of laundry, or sever one portion 18 from the dissolvable sheet 10 to use with a half load of laundry.

Preferably, the dissolvable sheet 10 may have an aesthetic visual and tactile structure, including a uniformly coloured and/or pattern, a spongy texture, which feels silky smooth, and dry to the touch, and has characteristics resembling those of fabric, such as being pliable, without breaking or cracking when being handled.

Having described an embodiment of the dissolvable sheet 10 of the present invention, a method of making a dissolvable sheet containing a cleaning active in the form of a water-soluble laundry detergent sheet 10, which is free of sulfates and ethoxylates, is described next. Good results have been obtained with this method for making 102 mm by 102 mm square sheets, which can be deposited in the tub of a washing machine with clothes at the start of the wash cycle, or placed in the washing machine's detergent dispenser.

According to a preferred embodiment of the present invention, the ingredients used to make the dissolvable sheets 10 are mixed in three separate batches. A First Solution and a Second Solution may be made separately in two large batches because they are preferably made to be shelf-stable, in that they are storable for a relatively long period of time (i.e. from two days to two months or longer) after the ingredients are thoroughly mixed together. A Final Solution, which includes portions of the First Solution and the Second Solution, may be made in a smaller batch for immediate use. The Final Solution is typically non-shelf-stable, in that it is usable only for a relatively short period of time (i.e. four to eight hours) after the ingredients are thoroughly mixed together, because it tends to deteriorate.

Although it may be advantageous to make the dissolvable sheets 10 using the above three batch system (i.e. First Solution, Second Solution, and Final Solution), in a large scale manufacturing operation, it will be appreciated that the Final Solution may be made directly, without needing to first prepare the First and Second Solutions. All such embodiments are comprehended by the present invention.

Preferably, the Final Solution may be applied to a heated surface to dry, thereby forming the dissolvable sheet. Provided that the drying step is undertaken in a timely manner the deterioration problem identified above is avoided.

The drying step may be performed using a method known in the art, such as for example, drying on a hot plate, a non-stick (Teflon) pan, or one of the methods disclosed in U.S. Pat. No. 9,464,264, the disclosure of which is incorporated herein in its entirety by reference, whereby the Final Solution is dried to form the dissolvable sheet 10.

Preferably, the drying step may be performed using a heated cylinder of the type disclosed in U.S. Pat. No. 9,464,264, whereby a rising portion of an outer surface of the heated cylinder is brought into contact with the Final Solution as the heated cylinder is being rotated, to coat the outer surface with the Final Solution. The heated cylinder is sized and shaped to allow excess Second Solution to drain off the rising portion of the outer surface in a direction opposite to the direction of rotation. Preferably, an application reservoir for holding a liquid volume of the Final Solution is positioned against the rising portion of the outer surface, to allow an even coating to be drawn up onto the rising outer surface of the heated cylinder, and dried to form the dissolvable sheet 10.

Example 1

For preparing a dissolvable sheet 10 that is sulfate and ethoxylate free, the First Solution may preferably comprise at least:

a) from about 2 wt-% to about 30 wt-% of one or more Polyvinyl alcohols (PVA);
b) from about 2 wt-% to about 80 wt-% of a first cleaning active 14;
c) from about 1 wt-% to about 50 wt-% a Glycerol or a Glycol; and
d) from about 20 wt-% to 80 wt-% of Water.

Most preferably, the First Solution may comprise at least:

a) from about 7 wt-% to about 15 wt-% of one or more Polyvinyl alcohols (PVA);
b) from about 12 wt-% to about 30 wt-% of a first cleaning active 14;
c) from about 4 wt-% to about 10 wt-% a Glycerol or a Glycol; and
d) from about 31 wt-% to 50 wt-% of Water; and
e) from about 0.1 wt % to 5 wt-% of Preservative.

Examples of suitable Polyvinyl alcohols (PVA) include Polyvinyl alcohol (PVA) B-05, and Polyvinyl alcohol (PVA) B-17.

Examples of a suitable first cleaning active 14 include nonionic or anionic surfactants, such as, natural saponified soaps, Glucosides, Sulfonic acid salts, Sulfonates, Phosphoric acid esters, Carboxylic acid salts, Potassium cocoate, other saponified fatty acid soap products, Alkyl polyglucoside (C10-16) (i.e. manufactured by BASF Corporation under the trade name Glucopon® 425 N), Sodium lauryl glucose carboxylate, short/medium/long chain Glucoside surfactant, Alpha olefin sulfonate, and combinations thereof.

Preferably, the first cleaning active 14 may be an anionic surfactant, particularly, Potassium cocoate (i.e. manufactured by Derrek Soap Company under the trade name Ecoblend™ KCO).

More preferably, the first cleaning active 14 may be a combination of an anionic surfactant, particularly, Potassium cocoate, with a non-ionic surfactant, particularly, Alkyl polyglucoside (C10-16) (i.e. manufactured by BASF Corporation under the trade name Glucopon® 425 N).

An example of a suitable Preservative is Potassium sorbate, which is a food-grade preservative. The purpose of the preservative is to increase the shelf life of the First and Second Solutions by inhibiting bacteria growth. Accordingly, if a prolonged shelf life is not required, then the Preservative may be omitted.

Good results have been obtained using a First Solution, being made by mixing the following ingredients in the indicated amounts, which is enough to make about 5000 102 mm×102 mm×0.8 mm square water-soluble laundry sheets:

| Ingredients | Function | Weight (kg) | Wt-% |
|---|---|---|---|
| Polyvinyl alcohol (PVA) B-05 | biodegradable supporting matrix | 1.60 | 2.9 |
| Polyvinyl alcohol (PVA) B-17 | biodegradable supporting matrix | 5.10 | 9.4 |
| Potassium sorbate | food-grade preservative | 0.02 | 0.1 |
| Alkyl polyglucoside (C10-16) | plant-based, biodegradable surfactant (non-ionic) | 1.00 | 1.8 |
| Potassium cocoate | plant-based, biodegradable surfactant (anionic) | 12.00 | 22.1 |
| Glycerin | improve texture of sheets and stability of sheet | 3.60 | 6.6 |
| Water | natural solvent, used temporarily during manufacturing as a process aid | 31.00 | 57.1 |
| Total | | 54.32 kg | 100.0% |

The above First Solution, including Potassium cocoate, may be used up to 48 hours after being prepared, with proper storage.

The Second Solution may preferably comprise at least:

a) optionally, from about 0.5 wt-% to about 20 wt-% of one or more enzymes;
b) from about 1 wt-% to about 60 wt-% of a second cleaning active 14;
c) from about 4 wt-% to about 80 wt-% of a third cleaning active 14;
d) from about 5 wt-% to about 30 wt-% of one or more water softeners and chelating agents; and
e) from about 5 wt-% to about 40 wt-% of Water.

Most preferably, the Second Solution may comprise at least:

a) optionally, from about 5 wt-% to about 20 wt-% of one or more enzymes;
b) from about 10 wt-% to about 30 wt-% of a second cleaning active 14;
c) from about 50 wt-% to about 80 wt-% of a third cleaning active 14;
d) from about 15 wt-% to about 30 wt-% of one or more water softeners and chelating agents;
e) from about 10 wt-% to about 30 wt-% of Water; and
f) from about 0.1 wt-% to about 5 wt-% of Preservative.

Examples of suitable enzymes include Protease, Amylase, Pectinase, Lipase, Cellulase, and Mannanase enzymes.

However, inclusion of enzymes in the Second Solution (and/or Final Solution) is optional, and as mentioned above, care needs to be taken when incorporating enzymes into the Second Solution (and/or the Final solution), as their activity can be stopped when subjected to high heat, such as for example, during the drying step. Thus, if the temperatures in any of the processing steps are expected to be higher than what the enzymes will tolerate (i.e. about 60° C.), it is preferable to omit the enzymes, as it is unlikely that they will remain functional in the resulting dissolvable sheet 10.

Examples of a suitable second cleaning active 14 include cationic, zwitterionic, or anionic surfactants, such as, natural saponified soaps, Glucosides, Sulfonic acid salts, Sulfonates, Phosphoric acid esters, Carboxylic acid salts, Amphoacetates, Sultaines, Betaines, Cocoamidaproply betaine (also known as CocoBetaine), Potassium cocoate, Cocamidopropyl hydroxysultaine, Sodium lauroamphoacetate, and combinations thereof.

Preferably, the second cleaning active 14 may be an amphoteric and zwitterionic surfactant, particularly, Cocamidopropyl betaine (i.e. manufactured by Walsh & Associates, Inc., St. Louis, Missouri, under the trade name Walwet™ CAPB).

Examples of a suitable third cleaning active 14 include amphoteric or nonionic surfactants, such as, Amine oxides, Glucosides, Sulfonic acid salts, Sulfonates, Phosphoric acid esters, Carboxylic acid salts, Cetyl betaine, Lauramine oxide, Sodium lauriminodipropionate, Alkyl polyglucoside (C10-16) (i.e. manufactured by BASF Corporation under the trade name Glucopon® 425 N), Sodium lauryl glucose carboxylate, short/medium/long chain Glucoside surfactant, specialty glucosides, such as, Disodium alkylpolyglucose citrate, and combinations thereof.

Preferably, the third cleaning active 14 may be an amphoteric and non-ionic surfactant, such as, Lauramine oxide, Alkyl polyglucoside (C10-16) (i.e. manufactured by BASF Corporation under the trade name Glucopon® 425 N), Sodium laurylglucosides hydroxypropylsulfonate, and combinations thereof. Most preferably, the third cleaning active 14 may be Alkyl polyglucoside (C10-16) in combination with Lauramine oxide.

Examples of suitable release agents and additives include Oils, Silicones, Plant oils, Triglycerides, Glycols, Glycerols, Paraffins, Waxes, and Mineral oil.

Examples of a suitable water softener and chelating agent include Aminopolycarboxylates, Glutamate diacetate, Ethylenediaminetetraacetic acid, Nitrilotriacetic acid, Gluconates, Aminopolycarboxylic acids, Sodium gluconate, Tetrasodium GLDA, and Carboxymethyl inulin (i.e. manufactured by Cosun Biobased Products B.V., Dinteloord, The Netherlands, under the trade name Carboxyline® 25 D Powder).

Preferably, the water softener and chelating agent may be a plant based biodegradable water solubilizer such as, for example, Sodium gluconate, Tetrasodium GLDA, or Carboxymethyl inulin.

Good results have been obtained using a Second Solution being made by mixing the following ingredients in the indicated amounts, which is enough to make 5000 102 mm×102 mm×0.8 mm square water-soluble laundry sheets:

| Ingredients | Function | Weight (kg) | Wt-% |
|---|---|---|---|
| Medley ® Brilliant 100 L | liquid enzyme blend | 0.5 | 4.5 |
| Cocamidopropyl betaine | coconut oil based, biodegradable surfactant and foam booster (amphoteric and zwitterionic) | 1.0 | 9.0 |
| Tetrasodium GLDA (Liquid 50%) | plant-derived and food grade, biodegradable water softener | 2.0 | 18.0 |
| Alkyl polyglucoside (C10-16) | plant based, biodegradable surfactant (non-ionic) | 5.0 | 45.1 |
| Sodium gluconate | plant-derived and food grade, biodegradable water softener that prevents soil from resettling on fabric after it has been removed during washing | 0.1 | 0.9 |
| Lauramine oxide | plant-derived, biodegradable, surfactant and foam stabilizer (non-ionic) | 1.0 | 9.0 |
| Water | natural solvent, used temporarily during manufacturing as a process aid | 1.5 | 13.5 |
| Total | | 11.1 kg | 100.0% |

The above Second Solution, may be used up to about two months after being prepared, with proper storage.

The Final Solution may preferably comprise at least:

a) from about 10 wt-% to about 80 wt-% of the above First Solution;

b) from about 10 wt-% to about 80 wt-% of the above Second Solution;

c) from about 5 wt-% to about 50 wt-% of a starch powder;

d) from about 5 wt-% to about 50 wt-% of a fourth cleaning active 14;

e) from about 0.1 wt-% to about 10 wt-% of a release agent or additive;

f) optionally, from about 0.1 wt-% to about 6 wt-% of a fragrance;

g) from about 0.1 wt-% to about 10 wt-% of a stabilizer, water treatment, scale inhibitor, soil anti-redeposition agent; and h) from about 0.1 wt-% to about 20 wt-% of Water.

Examples of a suitable fourth cleaning active 14 include ionic, anionic, zwitterionic, cationic, or amphoteric surfactants, such as, Amine oxides, Glucosides, Sulfonic acid salts, Sulfonates, Phosphoric acid esters, Carboxylic acid salts, Cetyl betaine, Lauramine oxide, Sodium lauriminodipropionate, Alkyl polyglucoside (C10-16) (i.e. manufactured by BASF Corporation under the trade name Glucopon® 425 N), Sodium lauryl glucose carboxylate, short/medium/long chain Glucoside surfactant, Sodium laurylglucosides hydroxypropylsulfonate, and combinations thereof.

Preferably, the fourth cleaning active 14 may be an amphoteric and non-ionic surfactant, particularly, Sodium laurylglucosides hydroxypropylsulfonate.

Sodium laurylglucosides hydroxypropylsulfonate (i.e. manufactured by Colonial Chemical, South Pittsburgh, TN, under the trade name Suga®Nate 160 Dry) is a 100% biobased sulfate-free surfactant in anhydrous form. Unexpectedly, the applicant has discovered that Sodium laurylglucosides hydroxypropylsulfonate may be used both as a water-soluble substrate builder as well as a cleaning active. Without being bound to a particular theory, it is believed that the matrix formed by the Starch and PVA is capable of accommodating the Sodium laurylglucosides hydroxypropylsulfonate molecules within its structure, and holds together as a unitary physical structure when dried, unlike any of the other cleaning actives mentioned above.

Examples of suitable release agents or additives include Oils, Silicones, Plant oils, Triglycerides, Glycols, Glycerols, Paraffins, Waxes, and Mineral oil.

Examples of suitable fragrances include natural fragrances such as essential oils, botanical extracts and natural aromachemicals to impart pleasant odor.

Examples of suitable stabilizer, water treatment, scale inhibitor, soil anti-redeposition agents, include Carboxymethyl inulin, water soluble polymers, partially neutralized Itaconic acid, Polyacrylate polymers, and Cellulose.

Good results have been obtained using a Final Solution being made by mixing the following ingredients in the indicated amounts, which is enough to make 5000 102 mm×102 mm×0.8 mm square water-soluble laundry sheets:

| Ingredients | Function | Weight (kg) | Wt-% |
|---|---|---|---|
| First Solution | concentrated stock solution | 54.32 | 67.4 |
| Second Solution | concentrated stock solution | 11.10 | 13.8 |
| Sodium laurylglucosides hydroxypropyl-sulfonate (i.e. Suga ® Nate 160 Dry) | plant-derived, biodegradable builder and surfactant | 4.00 | 5.0 |
| Starch powder | plant-derived, biodegradable texture/structure builder | 8.00 | 9.9 |
| Cellulose | plant-based, used as soil anti-redeposition agent | 1.00 | 1.2 |
| Glycerin | improve texture of sheets and slip, and boost cleaning performance of surfactants | 0.90 | 1.1 |
| Mineral oil | non-hazardous softener and processing aid (mold release agent for manufacturing process) | 0.20 | 0.2 |
| Essential oil blend (i.e. Lavender & Grapefruit) | natural essential oils, as replacement for synthetic fragrance | 0.60 | 0.7 |
| Carboxyline ® 25 D Powder | threshold crystal growth (scale inhibitor) | 0.50 | 0.6 |
| | Total | 80.62 kg | 100.0% |

The above Final Solution, is intended for immediate use, and should be discard after about 8 hours of being prepared.

When preparing the Final Solution, the First Solution is preferably mixed first with the starch powder for 1 minute. Then the Second Solution is added to the mixture, followed by the remaining ingredients. The mixture is mixed for 29 minutes. Preferably the final mixture will have a viscosity 75,500 cp at 20° C.

Next the Final Solution may be applied to a surface, dried into a sheet, and cut to produce 102 mm×102 mm square sheets, having an average thickness of 0.8 mm and an average weight of 4 grams, which represent one dose of laundry detergent for a large load of laundry. In this regard, an apparatus such as the apparatus for making a laundry detergent sheet disclosed in U.S. Pat. No. 9,464,264 may be used to dry the final mixture in the form of a sheet, and cut it to size the desired dimensions.

It is contemplated that some or all of the Starch powder in the Final Solution may be substituted with another suitable builder such as, for example, Sodium bicarbonate, Sodium carbonate, Cellulose, Stearates, and the like.

Similarly, it is contemplated that some or all of the Glycerin in the Final Solution may be substituted with Zemea® Propanediol (manufactured by DuPont Tate & Lyle Bio Products, LLC, Loudoni, TN), Augeo™ Clean (manufactured by Solvay, Houston, TX), or other plant based solvents.

Similarly, it is contemplated that some or all of the Mineral oil in the Final Solution may be substituted with another suitable oil, including a plant oil, a silicone, a glyceride, and the like.

Each 102 mm×102 mm square dissolvable sheet made according to the above example ended up having the following ingredients, in substantially the following amounts:

| Ingredients | Weight (g) | Wt-% |
|---|---|---|
| Polyvinyl alcohol (PVA) B-05 | 0.160 | 4.0% |
| Polyvinyl alcohol (PVA) B-17 | 0.524 | 13.1% |
| Potassium sorbate | 0.004 | 0.1% |
| Potassium cocoate | 0.636 | 15.9% |
| Glycerin | 0.372 | 9.3% |
| Medley ® Brilliant 100 L | 0.048 | 1.2% |
| Cocamidopropyl betaine | 0.044 | 1.1% |
| Tetrasodium GLDA - Liquid 50% | 0.096 | 2.4% |
| Alkyl polyglucoside (C10-16) | 0.280 | 7.0% |
| Sodium gluconate | 0.020 | 0.5% |
| Lauramine oxide | 0.052 | 1.3% |
| Sodium laurylglucosides hydroxypropylsulfonate (i.e. Suga ® Nate 160 Dry) | 0.424 | 10.6% |
| Starch powder | 0.920 | 23.0% |
| Cellulose | 0.024 | 0.6% |
| Glycerin | 0.096 | 2.4% |
| Mineral oil | 0.020 | 0.5% |
| Essential oil blend (i.e. Lavender & Grapefruit) | 0.052 | 1.3% |
| Carboxyline ® 25 D Powder | 0.052 | 1.3% |
| Water | 0.176 | 4.4% |
| Total | 4.000 g | 100.0% |

However, dissolvable sheets 10 according to other embodiments of the present invention, may be made to have the following ingredients, in substantially the following amounts:

| Ingredients | Wt-% |
|---|---|
| Polyvinyl alcohol (PVA) B-05 | about 2% to about 8% |
| Polyvinyl alcohol (PVA) B-17 | about 10% to about 20% |
| Potassium Sorbate | 0% to about 1% |
| Potassium cocoate | about 10% to about 25% |
| Glycerin | about 5% to about 20% |
| Medley ® Brilliant 100 L | 0% to about 5% |
| Cocamidopropyl betaine | about 1% to about 10% |
| Tetrasodium GLDA - Liquid 50% | about 1% to about 5% |
| Alkyl polyglucoside (C10-16) | about 5% to about 20% |
| Sodium gluconate | 0% to about 5% |
| Lauramine oxide | about 1% to about 10% |
| Sodium laurylglucosides hydroxypropylsulfonate (i.e. Suga ® Nate 160 Dry) | about 5% to about 40% |
| Starch powder | 10% to about 25% |
| Cellulose | 0% to about 5% |
| Mineral oil | 0% to about 5% |
| Essential oil blend (i.e. Lavender & Grapefruit) | 0% to about 5% |
| Carboxyline ® 25 D Powder | 0% to about 5% |
| Water | 0% to about 10% |
| Total | 100.0% |

Example 2

The shelf-life of the First Solution may be extended significantly, from about 48 hours to two months or more, primarily by replacing the Potassium cocoate with Alpha olefin sulfonate (AOS).

Most preferably, the First Solution may comprise at least:

a) from about 7 wt-% to about 15 wt-% of one or more Polyvinyl alcohols (PVA);
b) from about 7 wt-% to about 30 wt-% of a first cleaning active 14;
c) from about 4 wt-% to about 15 wt-% a Glycerol or a Glycol;
d) from about 50 wt-% to 70 wt-% of Water; and
e) from about 0.5 wt-% to 2 wt-% of Preservative Preferably, the first cleaning active 14 may be the anionic surfactant, Alpha olefin sulfonate (i.e manufactured by Stephan Company and sold under the trade name Bio-Terge® AS-40 HP).

Good results have been obtained using a First Solution, being made by mixing the following ingredients in the indicated amounts, which is enough to make about 5000 102 mm×102 mm×0.8 mm square water-soluble laundry sheets:

| Ingredients | Function | Weight (kg) | Wt-% |
|---|---|---|---|
| Polyvinyl alcohol (PVA) B-05 | biodegradable supporting matrix | 1.674 | 3.00 |
| Polyvinyl alcohol (PVA) B-17 | biodegradable supporting matrix | 5.580 | 10.00 |
| Potassium sorbate | food-grade preservative | 0.022 | 0.04 |
| Alpha olefin sulfonate | plant-based, biodegradable surfactant (non-ionic) | 11.160 | 20.00 |
| Glycerin | improve texture of sheets and stability of sheet | 3.906 | 7.00 |
| Water | natural solvent, used temporarily during manufacturing as a process aid | 33.458 | 59.96 |
| Total | | 55.8 kg | 100.0% |

The above First Solution, including Alpha olefin sulfonate, may be used up to two months after being prepared, with proper storage.

Most preferably, the Second Solution may comprise at least:

a) from about 5 wt-% to about 20 wt-% of one or more enzymes;
b) from about 10 wt-% to about 30 wt-% of a second cleaning active 14;
c) from about 50 wt-% to about 80 wt-% of a third cleaning active 14;
d) from about 15 wt-% to about 30 wt-% of one or more water softeners and chelating agents; and
e) from about 10 wt-% to about 30 wt-% of Water.

Examples of a suitable enzyme, second cleaning active 14, release agents, additives, water softeners, and chelating agents, include the same ones previously mentioned above.

Preferably, the second cleaning active 14 may be Alkyl polyglucoside (C10-16) (i.e. manufactured by BASF Corporation under the trade name Glucopon® 425 N).

Examples of a suitable third cleaning active 14 include amphoteric or nonionic surfactants, such as, Amine oxides, Glucosides, Sulfonic acid salts, Sulfonates, Phosphoric acid esters, Carboxylic acid salts, Cetyl betaine, Lauramine oxide, Sodium lauriminodipropionate, an amphoteric and zwitterionic surfactant, particularly, Cocamidopropyl betaine (i.e. manufactured by Walsh & Associates, Inc., St. Louis, Missouri, under the trade name Walwet™ CAPB), Sodium lauryl glucose carboxylate, short/medium/long chain Glucoside, specialty glucosides, such as, Disodium alkylpolyglucose citrate, and combinations thereof.

Preferably, the third cleaning active 14 may be an amphoteric and non-ionic surfactant, such as, Lauramine oxide, Alkyl polyglucoside (C10-16) (i.e. manufactured by BASF Corporation under the trade name Glucopon® 425 N), Sodium laurylglucosides hydroxypropylsulfonate, and combinations thereof. Most preferably, the third cleaning active 14 may be Alkyl polyglucoside (C10-16) in combination with Lauramine oxide.

Good results have been obtained using a Second Solution being made by mixing the following ingredients in the indicated amounts, which is enough to make 5000 102 mm×102 mm×0.8 mm square water-soluble laundry sheets:

| Ingredients | Function | Weight (kg) | Wt-% |
|---|---|---|---|
| Medley ® Brilliant 100 L | liquid enzyme blend | 4.23 | 34.10 |
| Cocamidopropyl betaine | coconut oil based, biodegradable surfactant and foam booster (amphoteric and zwitterionic) | 0.74 | 5.93 |
| Tetrasodium GLDA (Liquid 50%) | plant-derived and food grade, biodegradable water softener | 1.31 | 10.54 |
| Alkyl polyglucoside (C10-16) | plant based, biodegradable surfactant (non-ionic) | 3.68 | 29.66 |
| Sodium gluconate | plant-derived and food grade, biodegradable water softener that prevents soil from resettling on fabric after it has been removed during washing | 0.08 | 0.66 |
| Lauramine oxide | plant-derived, biodegradable, surfactant and foam stabilizer (non-ionic) | 0.74 | 5.93 |
| Water | natural solvent, used temporarily during manufacturing as a process aid | 1.64 | 13.18 |
| Total | | 12.42 kg | 100.0% |

The above Second Solution, may be used up to about two months after being prepared, with proper storage.

The Final Solution may preferably comprise at least:

a) from about 10 wt-% to about 80 wt-% of the above First Solution;
b) from about 10 wt-% to about 80 wt-% of the above Second Solution;
c) from about 5 wt-% to about 50 wt-% of a starch powder;
d) from about 5 wt-% to about 50 wt-% of a fourth cleaning active 14;
e) from about 0.1 wt-% to about 10 wt-% of a release agent or additive;
f) optionally, from about 0.1 wt-% to about 6 wt-% of a fragrance;
g) from about 0.1 wt-% to about 10 wt-% of a stabilizer, water treatment, scale inhibitor, soil anti-redeposition agent; and
h) from about 0.1 wt-% to about 20 wt-% of Water.

Examples of a suitable fourth cleaning active 14, release agents, additives, fragrances, stabilizer, water treatment, scale inhibitor, and soil anti-redeposition agents, include the same ones previously mentioned above.

Good results have been obtained using a Final Solution being made by mixing the following ingredients in the indicated amounts, which is enough to make 5000 102 mm×102 mm×0.8 mm square water-soluble laundry sheets:

| Ingredients | Function | Weight (kg) | Wt-% |
|---|---|---|---|
| First Solution | concentrated stock solution | 55.800 | 66.90 |
| Second Solution | concentrated stock solution | 12.405 | 14.87 |
| Sodium laurylglucosides hydroxypropylsulfonate (i.e. Suga ® Nate 160 Dry) | plant-derived, biodegradable builder and surfactant | 4.000 | 4.80 |
| Starch powder | plant-derived, biodegradable texture/structure builder | 9.000 | 10.79 |
| Glycerin | improve texture of sheets and slip, and boost cleaning performance of surfactants | 0.900 | 1.08 |
| Mineral oil | non-hazardous softener and processing aid (mold release agent for manufacturing process) | 0.200 | 0.24 |
| Essential oil blend (i.e. Lavender & Grapefruit) | natural essential oils, as replacement for synthetic fragrance | 0.600 | 0.72 |
| Carboxyline ® 25 D Powder | threshold crystal growth (scale inhibitor) | 0.500 | 0.60 |
| Total | | 83.41 kg | 100.0% |

The above Final Solution, is intended for immediate use, and should be discarded after about 8 hours of being prepared.

When preparing the Final Solution, the First Solution is preferably mixed first with the starch powder for 1 minute. Then the Second Solution is added to the mixture, followed by the remaining ingredients. The mixture is mixed for 45 minutes. Preferably the final mixture will have a viscosity 35,000 cp at 20° C.

Next the Final Solution may be applied to a surface, dried into a sheet, and cut to produce 102 mm×102 mm square sheets, having an average thickness of 0.8 mm and an average weight of 4 grams, which represent one dose of laundry detergent for a large load of laundry. In this regard, an apparatus such as the apparatus for making a laundry detergent sheet disclosed in U.S. Pat. No. 9,464,264 may be used to dry the final mixture in the form of a sheet, and cut it to size the desired dimensions.

Each 102 mm×102 mm square dissolvable sheet made according to the above example ended up having the following ingredients, in substantially the following amounts:

| Ingredients | Weight (g) | Wt-% |
|---|---|---|
| Polyvinyl alcohol (PVA) B-05 | 0.177 | 4.42% |
| Polyvinyl alcohol (PVA) B-17 | 0.590 | 14.74% |
| Potassium sorbate | 0.002 | 0.06% |
| Alpha olefin sulfonate (AOS) | 0.467 | 11.68% |
| Glycerin | 0.430 | 10.75% |
| Medley ® Brilliant 100 L | 0.013 | 0.32% |
| Cocamidopropyl betaine | 0.031 | 0.78% |
| Tetrasodium GLDA - Liquid 50% | 0.063 | 1.56% |
| Alkyl polyglucoside (C10-16) | 0.205 | 5.12% |

-continued

| Ingredients | Weight (g) | Wt-% |
|---|---|---|
| Sodium gluconate | 0.009 | 0.23% |
| Lauramine oxide | 0.025 | 0.61% |
| Sodium laurylglucosides hydroxypropylsulfonate (i.e. Suga ® Nate 160 Dry) | 0.423 | 10.57% |
| Starch powder | 0.971 | 24.28% |
| Copolymer of 1-vynilimidazole and 1-vynil-2-pyrrolidone (i.e. Sokalan ® PA 25 CL Granular) | 0.035 | 0.88% |
| Glycerin | 0.099 | 2.48% |
| Mineral oil | 0.022 | 0.55% |
| Essential oil blend (i.e. Lavender & Grapefruit) | 0.067 | 1.67% |
| Carboxyline ® 25 D Powder | 0.052 | 1.31% |
| Water | 0.320 | 8.00% |
| Total | 4.00 g | 100.0% |

However, dissolvable sheets 10 according to other embodiments of the present invention, may be made to have the following ingredients, in substantially the following amounts:

| Ingredients | Wt-% |
|---|---|
| Polyvinyl alcohol (PVA) B-05 | about 2% to about 8% |
| Polyvinyl alcohol (PVA) B-17 | about 10% to about 20% |
| Potassium Sorbate | 0% to about 1% |
| Alpha olefin Sulfonate (AOS) | about 10% to about 25% |
| Glycerin | about 5% to about 20% |
| Medley ® Brilliant 100 L | 0% to about 5% |
| Cocamidopropyl betaine | about 1% to about 10% |
| Tetrasodium GLDA - Liquid 50% | about 1% to about 5% |
| Alkyl polyglucoside (C10-16) | about 5% to about 20% |
| Sodium gluconate | 0% to about 5% |
| Lauramine oxide | about 1% to about 10% |
| Sodium laurylglucosides hydroxypropylsulfonate (i.e. Suga ® Nate 160 Dry) | about 5% to about 40% |
| Starch powder | 10% to about 30% |
| Copolymer of 1-vynilimidazole and 1-vynil-2-pyrrolidone (i.e. Sokalan ® PA 25 CL Granular) | 0% to about 5% |
| Mineral oil | 0% to about 5% |
| Essential oil blend (i.e. Lavender & Grapefruit) | 0% to about 5% |
| Carboxyline ® 25 D Powder | 0% to about 5% |
| Water | 0% to about 10% |
| Total | 100.0% |

As can now be appreciated, the present invention allows a dissolvable sheet containing a cleaning active to be made, that is free of sulfates and ethoxylates. For example, at least some prior art dissolvable laundry detergent sheets are made with Alpha olefin sulfonate (an example of a petroleum derived sulfonate), Sodium lauryl sulfate (an example of a petroleum derived sulfate surfactant), and Peg-7 glyceryl cocoate (an example of a petroleum derived ethoxylated surfactant). These three ingredients were previously thought to be necessary for making dissolvable laundry detergent sheets having a useful laundry detergent payload for satisfactory cleaning performance, an aesthetic appearance and texture, and a desirable form factor.

Surprisingly, however, the applicant has found a selection and combination of chemical compounds as substitutes for the above sulfate and ethoxylated surfactants, while retaining substantially the same performance and aesthetic attributes of the prior art dissolvable laundry detergent sheets.

Additionally, the applicant has found that sulfate free and ethoxylate free surfactants that were previously not considered to be compatible with other ingredients used to make prior art dissolvable laundry sheets, could be made to work by balancing multiple sulfate and ethoxylate free surfactants with differing ionic charges and characters to create a synergistic effect of cleaning and the creation of micelles.

Similarly, sulfate free and ethoxylate free surfactants that were not previously considered to be compatible with other ingredients used to make prior art dissolvable laundry sheets, may be made to work by increasing the total amount of sulfate and ethoxylate free surfactants (for example, in the Second Solution) and reducing the total amount of Water being added as a temporary solvent, to form a critical micelle concentration (CMC). The CMC has been found to significantly improve the cleaning performance of the resulting dissolvable sheets 10. The CMC also allows the shelf-stable solutions (for example, the Second Solution) to emulsify otherwise insoluble or unstable ingredients. Thus, combining surfactants in the Second Solution to form a CMC, as described above, may be a useful step in a method for making dissolvable sheets 10 with improved cleaning performance, and for incorporating otherwise unstable or insoluble chemical compounds into the dissolvable sheets 10. Advantageously, this effect may be controlled by adjusting the ionic charge of the surfactant cleaning actives in the First and Second Solutions.

Additionally, the applicant has found that by reducing the amount of Water being added as a temporary solvent in the First and/or Second Solutions, and/or using the Water content present in certain ionic and nonionic surfactants when formulating the First and/or Second Solutions, is it possible to increase the overall concentration of the cleaning active(s) in the dissolvable sheets 10.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art. Those of ordinary skill in the art having access to the teachings herein will recognize these additional variations, implementations, modifications, alterations and embodiments, all of which are within the scope of the present invention, which invention is limited only by the appended claims.

We claim:

1. A laundry or dishwashing non-fibrous dissolvable sheet formed on a heated surface, comprising:

from about 12 wt-% to about 28 wt-% of polyvinyl alcohol (PVA);

from about 10 wt-% to about 30 wt-% of starch;

from about 10 wt-% to about 25 wt-% of potassium cocoate or alpha olefin sulfonate;

from about 5 wt-% to about 20 wt-% of glycerin;

from about 5 wt-% to about 40 wt-% of sodium lauryl-glucosides hydroxypropylsulfonate; and from 0 wt-% to about 5 wt-% of one or more enzymes;

wherein said dissolvable sheet is free of sulfate and ethoxylate surfactants.

2. The dissolvable sheet as claimed in claim 1, further comprising a food grade preservative.

3. The dissolvable sheet as claimed in claim 2, wherein said preservative comprises potassium sorbate.

4. The dissolvable sheet as claimed in claim 1, a wherein said one or more enzymes comprise amylase enzymes, pectinase enzymes, lipase enzymes, cellulase enzymes, mannanase enzymes, or a combination thereof.

5. The dissolvable sheet as claimed in claim 1, further comprising a release agent.

6. The dissolvable sheet as claimed in claim 5, wherein said release agent comprises an oil, a plant oil, a glyceride, a triglyceride, a glycol, a glycerol, a paraffin, a wax, or a mineral oil.

7. The dissolvable sheet as claimed in claim 1, further comprising a water softener and chelating agent.

8. The dissolvable sheet as claimed in claim 7, wherein said water softener and chelating agent comprises aminopolycarboxylate, glutamate diacetate, ethylenediaminetetraacetic acid, nitrilotriacetic acid, gluconate, aminopolycarboxylic acid, sodium gluconate, tetrasodium glutamate diacetate or carboxymethyl inulin.

9. The dissolvable sheet as claimed in claim 1, further comprising a fragrance.

10. The dissolvable sheet as claimed in claim 9, wherein said fragrance comprises an essential oil, a botanical extract, or a natural aromachemical.

11. The dissolvable sheet as claimed in claim 1, further comprising a scale inhibitor, wherein said scale inhibitor is a carboxymethyl inulin, or a polyacrylate polymer.

12. The dissolvable sheet as claimed in claim 1, further comprising:

from about 1 wt-% to about 10 wt-% of cocoamidopropyl betaine;

a from about 1 wt-% to about 5 wt-% of a 50% liquid glutamate diacetate;

from about 5 wt-% to about 20 wt-% an alkyl polyglucoside having 10-16 carbons; and from about 1 wt-% to about 10 wt-% of lauramine oxide.

* * * * *